US009483988B2

(12) United States Patent
Xi et al.

(10) Patent No.: US 9,483,988 B2
(45) Date of Patent: Nov. 1, 2016

(54) DRIVING METHOD AND DRIVING DEVICE FOR LIQUID CRYSTAL PANEL, AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Yusheng Xi, Beijing (CN); Hongtao Lin, Beijing (CN); Haichen Hu, Beijing (CN)

(73) Assignees: BOE TECHNOLOGY GROUP CO., LTD.; BEIJING BOE DISPLAY TECHNOLOGY CO., LTD.

( * ) Notice: Subject to any disclaimer, the term of this patent is extended or adjusted under 35 U.S.C. 154(b) by 0 days.

(21) Appl. No.: 14/097,350

(22) Filed: Dec. 5, 2013

(65) Prior Publication Data

US 2014/0152722 A1 Jun. 5, 2014

(30) Foreign Application Priority Data

Dec. 5, 2012 (CN) ..... 2012 1 0517848

(51) Int. Cl.
*G09G 3/36* (2006.01)

(52) U.S. Cl.
CPC ..... *G09G 3/3614* (2013.01); *G09G 2320/0204* (2013.01); *G09G 2320/0247* (2013.01); *G09G 2320/0257* (2013.01); *G09G 2340/16* (2013.01)

(58) Field of Classification Search
None
See application file for complete search history.

(56) References Cited

U.S. PATENT DOCUMENTS 5,838,293 A * 11/1998 Kondoh ..... G09G 3/3633 345/97
7,030,843 B2 * 4/2006 Youn ..... 345/86
7,443,372 B2 * 10/2008 Lee ..... G02F 1/134363 345/209
7,847,780 B2 * 12/2010 Chang ..... G09G 3/3614 345/100
8,212,845 B2 * 7/2012 Lee ..... G09G 3/3614 345/690
8,643,633 B2 * 2/2014 Sakashita ..... 345/204

(Continued)

FOREIGN PATENT DOCUMENTS

CN 101226724 7/2008
JP 2011145667 7/2011

OTHER PUBLICATIONS

Notification of First Office Action, App. No. 2012105178482, dd Apr. 17, 2014.

(Continued)

*Primary Examiner* — Dismery Mercedes
(74) *Attorney, Agent, or Firm* — Baker Hostetler LLP

(57) ABSTRACT

The present invention relates to a liquid crystal display and more particularly to a driving method and driving device for a liquid crystal panel, and to a liquid crystal display device comprising a liquid crystal panel. The driving method comprises: receiving an original input signal; judging whether or not a current time is within a signal conversion phase; and when the judgment result indicates that the current time is within the signal conversion phase, generating a target driving signal based on the original input signal, and outputting the target driving signal to a data line of a liquid crystal panel or generating an original driving signal based on the original input signal and outputting the original driving signal to the data line. The polarity of the target driving signal is opposite to that of the original driving signal. An amplitude of the target driving signal corresponding to a first frame within the signal conversion phase is less than an amplitude of the original driving signal.

11 Claims, 3 Drawing Sheets

(56) References Cited

U.S. PATENT DOCUMENTS 8,754,837 B2 * 6/2014 Yamato ..... G09G 3/3648 345/209
8,872,748 B2 * 10/2014 Cho ..... G09G 3/3677 345/100
2007/0152942 A1 * 7/2007 Yamagishi ..... G09G 3/3614 345/96
2007/0195045 A1 * 8/2007 Kaneki ..... G09G 3/3614 345/96
2007/0211008 A1 * 9/2007 Lee ..... 345/98
2007/0296673 A1 * 12/2007 Kang ..... G09G 3/3406 345/92
2008/0094334 A1 * 4/2008 Baek ..... G09G 3/3677 345/89
2008/0136761 A1 * 6/2008 Hong ..... G09G 3/2022 345/89
2008/0170020 A1 * 7/2008 Kim ..... G09G 3/2011 345/89
2008/0238953 A1 * 10/2008 Ogura ..... G09G 3/3275 345/697
2008/0284704 A1 * 11/2008 Song ..... G09G 3/3614 345/94
2009/0085907 A1 * 4/2009 Kim ..... G09G 3/3611 345/213
2011/0242140 A1 * 10/2011 Lee ..... G09G 3/3648 345/690
2012/0218246 A1 * 8/2012 Ueda ..... G02F 1/13624 345/211
2013/0069928 A1 * 3/2013 Mizusako ..... G09G 3/3611 345/212
2013/0147856 A1 * 6/2013 Chou ..... G09G 3/3266 345/690

OTHER PUBLICATIONS

Decision of Rejection,Oct. 30, 2014.

* cited by examiner

DRIVING METHOD AND DRIVING DEVICE FOR LIQUID CRYSTAL PANEL, AND DISPLAY DEVICE

CROSS REFERENCE

The present application claims a priority of the Chinese patent application No. 201210517848.2 filed on Dec. 5, 2012, which is incorporated herein by reference in its entirety.

TECHNICAL FIELD

The present invention relates to a field of driving technology, in particular to a driving method and a driving device for a liquid crystal panel, and a display device.

BACKGROUND

Recently, liquid crystal display has been closely related with people's daily life, and the products such as liquid crystal mobile phones, liquid crystal display devices, and liquid crystal televisions have taken all or most of the market shares. Along with an increased quantity of the liquid crystal products and a wider application thereof, there is a high demand on the display quality of the liquid crystal products, such as wide viewing angle, high contrast, rapid image switching (rapid response time), low power consumption and stable images.

To obtain a stable image, one of the problems to be solved is "afterimage". The so-called "afterimage" refers to image sticking, generally including "surface afterimage" and "line afterimage". The essential causes for the two afterimages are the same, i.e., when a static image is maintained by a liquid crystal screen for a long period of time, liquid crystal molecules will be polarized after being driven by charges for a long period of time, so that the liquid crystal molecules cannot be deflected normally under the control of a signal voltage. In other words, even if the displayed contents are changed, traces of the static image may still be seen on the screen.

Generally, TV signals are transmitted in an interlaced scanning manner, so as to save the transmission bandwidth for the signals. The so-called interlaced scanning, contrary to progressive scanning, refers to the scanning of video display in an interlaced manner. Because the interlaced scanning is used for the TV signals while the progressive scanning is used for a LCD, with respect to the video signals transmitted in the interlaced scanning manner, it is required to reconstruct, in various ways, the missing even-numbered (odd-numbered) frame image information for odd-numbered (even-numbered) frame image information, so as to obtain a complete image signal.

A common way is to set a signal voltage for a middle row as an average value of those for the previous and next rows when the odd-numbered or even-numbered frame signals are input in the interlaced scanning manner.

The inventor finds that, serious line afterimages will occur for the liquid crystal panel with a circuit which inputs the signals in the interlaced scanning manner. These line afterimages may be removed by periodically reversing a driving signal input into a data line. However, such a method will cause an image to be flickered, especially for a static image.

SUMMARY

An object of the present invention is to provide a driving method and a driving device for a liquid crystal panel, and a display device, so as to reduce flickering by changing a driving mode when removing a line afterimage.

In one aspect, the present invention provides a driving method for a liquid crystal panel, used for an electronic device having the liquid crystal panel, comprising:

a reception step of receiving an original input signal;

a judgment step of judging whether or not a current time is within a signal conversion phase, to obtain a judgment result; and an output step of, when the judgment result indicates that the current time is within the signal conversion phase, generating a target driving signal based on the original input signal, and outputting the target driving signal to a data line of the liquid crystal panel so as to charge a pixel electrode, otherwise, generating an original driving signal based on the original input signal and outputting the original driving signal to the data line so as to charge the pixel electrode.

A polarity of the target driving signal is opposite to a polarity of the original driving signal, an amplitude of the target driving signal corresponding to a first frame within the signal conversion phase is less than an amplitude of the original driving signal.

A difference between a first voltage of the pixel electrode driven by the target driving signal and a second voltage of the pixel electrode driven by the original driving signal is less than a predetermined threshold.

The original input signal is a signal received by a timing controller, and the output step is executed by the timing controller and a data driving unit. The output step comprises:

when the judgment result indicates that the current time is within the signal conversion phase, generating, by the timing controller, a first source signal based on the original input signal and outputting the first source signal, otherwise generating and outputting a second source signal based on the original input signal; and processing, by the data driving unit, the first source signal and the second source signal from the timing controller according to a predetermined algorithm, and outputting processed signals to the data line.

The first source signal is processed by the data driving unit according to the predetermined algorithm to obtain the original driving signal, and the second source signal is processed to obtain the target driving signal.

In the output step, the second source signal is generated and output based on a difference between a grayscale corresponding to the target driving signal and a grayscale corresponding to the original driving signal and the first source signal.

The original input signal is the original driving signal generated and output by the data driving unit. The output step comprises:

when the judgment result indicates that the current time is within the signal conversion phase, receiving the original driving signal from the data driving unit, processing the original driving signal to obtain the target driving signal, and outputting the target driving signal to the data line of the liquid crystal panel; and when the judgment result indicates that the current time is not within the signal conversion phase, receiving the original driving signal from the data driving unit, and directly outputting the original driving signal to the data line of the liquid crystal panel.

The electronic device is a liquid crystal television.

In another aspect, the present invention provides a driving device for a liquid crystal panel, used for an electronic device having the liquid crystal panel, comprising:

a receiving module, configured to receive an original input signal;

a judging module, configured to judge whether or not a current time is within a signal conversion phase, to obtain a judgment result; and an outputting module, configured to, when the judgment result indicates that the current time is within the signal conversion phase, generate a target driving signal based on the original input signal, and output the target driving signal to a data line of the liquid crystal panel so as to charge a pixel electrode, otherwise, generate an original driving signal based on the original input signal and output the original driving signal to the data line so as to charge the pixel electrode.

The polarity of the target driving signal is opposite to the polarity of the original driving signal, and an amplitude of the target driving signal corresponding to a first frame within the signal conversion phase is less than an amplitude of the original driving signal.

A difference between a first voltage of the pixel electrode driven by the target driving signal and a second voltage of the pixel electrode driven by the original driving signal is less than a predetermined threshold.

The original input signal is a signal received by a timing controller, and the outputting module comprises:

a timing controller, configured to, when the judgment result indicates that the current time is within the signal conversion phase, generate a first source signal based on the original input signal and output the first source signal, otherwise generate and output a second source signal based on the original input signal; and a data driving unit, configured to process the first source signal and the second source signal from the timing controller according to a predetermined algorithm, and output processed signals to the data line.

The first source signal is processed by the data driving unit according to the predetermined algorithm to obtain the original driving signal, and the second source signal is processed to obtain the target driving signal.

The timing controller is specifically configured to generate the second source signal based on a difference between a grayscale corresponding to the target driving signal and a grayscale corresponding to the original driving signal and the first source signal, and output the second source signal.

The original input signal is the original driving signal generated and output by the data driving unit. The outputting module comprises:

a first processing unit, configured to, when the judgment result indicates that the current time is within the signal conversion phase, receive the original driving signal from the data driving unit, process the original driving signal to obtain the target driving signal, and output the target driving signal to the data line of the liquid crystal panel; and a second processing unit, configured to, when the judgment result indicates that the current time is not within the signal conversion phase, receive the original driving signal from the data driving unit, and directly output the original driving signal to the data line of the liquid crystal panel.

The electronic device is a liquid crystal television.

In yet another aspect, the present invention further provides a display device comprising a liquid crystal display panel and the above-mentioned driving device.

The present invention has at least one of the following beneficial effects.

According to the present invention, within the signal conversion phase, the polarity of an equivalent pixel bias voltage driven by the target driving signal is changed, and such a bias voltage can be offset by an equivalent pixel bias voltage within a signal non-conversion phase. As a result, it is able to reduce the amplitude of the equivalent pixel bias voltage during the entire display phase, thereby to reduce the possibility of line afterimages.

Meanwhile, according to the present invention, the amplitude of the driving signal with a reversed polarity is reduced voluntarily, so it is able to partially or fully cancel out an over-charge caused by continuous charging on a codirectional basis, and to reduce the flickering.

DETAILED DESCRIPTION

According to the driving method, the driving device and the display device of the present invention, reversion is performed on a signal within a signal conversion phase, and an amplitude of the reversed signal is less than an amplitude of the signal before the reversion, so it is able to reduce flickering while improving line afterimages.

At first, some issues concerned in the present invention are described so as to understand the present invention in a better manner.

Figure 1:
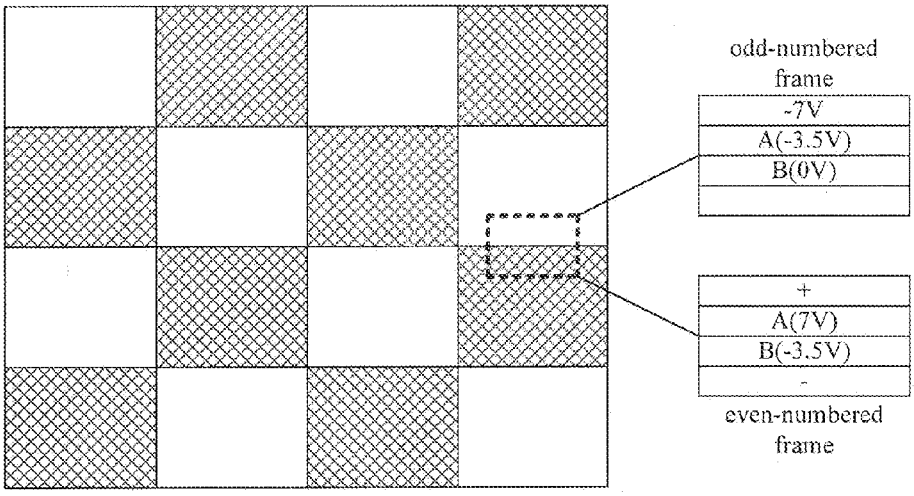
FIG. 1 is a schematic view showing an image to be displayed by a LCD and the voltage distribution thereof.

FIG. 1 is a schematic view showing an image to be displayed by a LCD. For convenience, the filled part in FIG. 1 refers to a dark image.

Followings are the analyses by taking the rows at the border between the dark and bright images.

Presumed that a positive/negative voltage applied in actual operation is 7V, as shown in FIG. 1, during the scanning of odd-numbered frames, row A at the border between the dark and bright images in the afterimage evaluation is the row that is not really scanned, and row B is the row that really inputs a signal. Presumed that the voltage of a previous row is −7V, and the voltage of row B is 0V, then the voltage of row A is −3.5V based on interpolation.

During the scanning of even-numbered frames, row A is the row that is really scanned, row B is the row that is not scanned, and a row next to row B is the row that really inputs a signal. Presumed that the voltage of row A is +7V and the voltage of the row next to row B is 0V, then the voltage of row B is −3.5V based on the polarity reversion and interpolation.

In a static image as shown in FIG. 1, row A at the border between the dark and bright images always has a bias voltage of −3.5V or +7V, while row B always has a bias voltage of −3.5V or 0V. In other words, during the overall display process of the image, an equivalent pixel bias voltage for row A is 3.5V, while an equivalent pixel bias voltage for row B is −3.5V. As a result, a line afterimage will occur after a period of time.

In order to remove a long time unidirectional DC bias for the liquid crystal, a normal polarity-reversal signal is converted to an opposite polarity-reversal signal within a certain period of time T, so as to remove the line afterimage.

Figure 2:
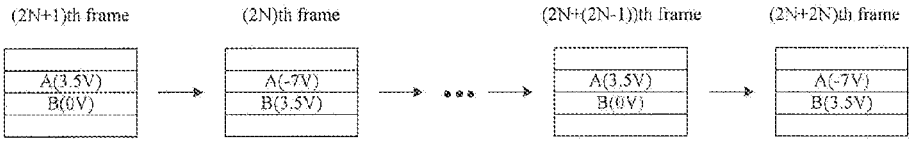
FIG. 2 is a schematic view showing the voltage distribution when performing the control by reversing a driving signal.
Figure 3:
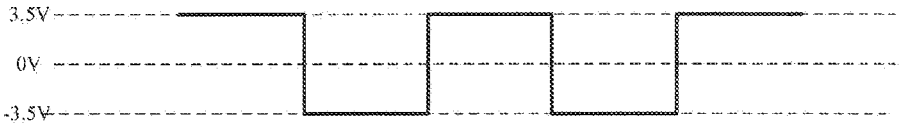
FIG. 3 is a schematic view showing an equivalent pixel bias voltage after the driving signal is reversed.

FIG. 2 is a schematic view showing the variation of the voltage after the polarity deflection of rows A and B. It is found that, within 2N frames from the $(2N+1)^{th}$ frame to the $(4N)^{th}$ frame, a control voltage for row A is 3.5V, −7V, 3.5V, −7V, . . . . Within the 2N frames, the equivalent pixel bias voltage for row A is −3.5V, while during normal operation, the equivalent pixel bias voltage for row A is 3.5V. Presumed that the conversion is performed over a period of T, the overall equivalent pixel bias voltage for row A, as shown in FIG. 3, is 0V, so the line afterimage at row A is removed.

The line afterimage at row B can also be removed in a similar manner.

Figure 4:
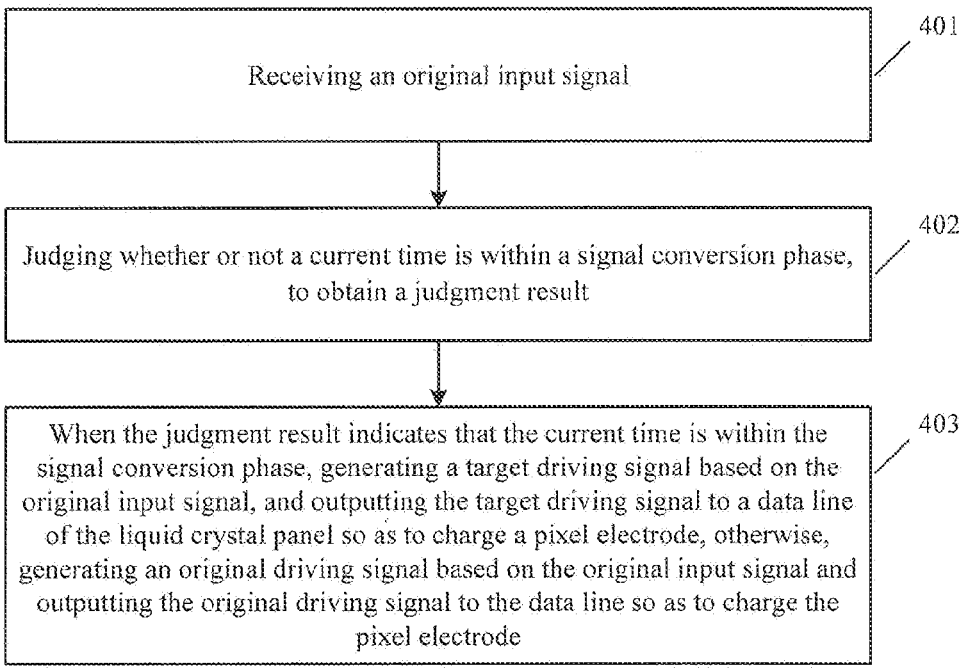
FIG. 4 is a flow chart of a driving method for a liquid crystal panel according to an embodiment of the present invention.

The present invention provides a driving method for a liquid crystal panel, used for an electronic device having the liquid crystal panel. As shown in FIG. 4, the driving method comprises the steps of:

Step 401: receiving an original input signal;

Step 402: judging whether or not a current time is within a signal conversion phase, to obtain a judgment result; and Step 403: when the judgment result indicates that the current time is within the signal conversion phase, generating a target driving signal based on the original input signal, and outputting the target driving signal to a data line of the liquid crystal panel so as to charge a pixel electrode, otherwise, generating an original driving signal based on the original input signal and outputting the original driving signal to the data line.

The polarity of the target driving signal is opposite to that of the original driving signal, and an amplitude of the target driving signal corresponding to a first frame within the signal conversion phase is less than an amplitude of the original driving signal.

In an embodiment of the present invention, within the signal conversion phase, the target driving signal is generated based on the original input signal and then output to the data line of the liquid crystal panel, and the target driving signal has a polarity opposite to the original driving signal originally output. In other words, within the signal conversion phase, as compared to be driven by the original driving signal, polarity change will also be caused to the equivalent pixel bias voltage driven by the target driving signal, and such equivalent pixel bias voltage will be offset by the equivalent pixel bias voltage within the signal non-conversion phase. As a result, it is able to reduce the equivalent pixel bias voltage within the entire display phase, thereby to reduce the possibility of the line afterimage.

Generally, for any pixel, the polarity of the driving signal loaded to a corresponding data line is converted every other frame. However, according to the method of the embodiment of the present invention, the driving signals of a first frame and a previous frame within the signal conversion phase have the same polarity. Within the signal conversion phase, the first frame is continuously charged positively/negatively based on a positive/negative voltage of the previous frame. In a mode where the adjacent frames have opposite polarities, the charging is performed at a high voltage, and after a voltage jump, the pixel voltage will be higher than the original pixel voltage, so inaccurate display will occur. In addition, when the images for two adjacent frames of a pixel are the same, the brightness of the pixel at the current frame is higher than that at the previous frame, so flickering will occur.

In contrast, according to the embodiment of the present invention, the voltage of the driving signal is reduced voluntarily, so it is able to partially or fully cancel out an overcharge caused by continuous charging on a codirectional basis, thereby to reduce the flickering.

Further explanations are given hereinafter.

Figure 5:
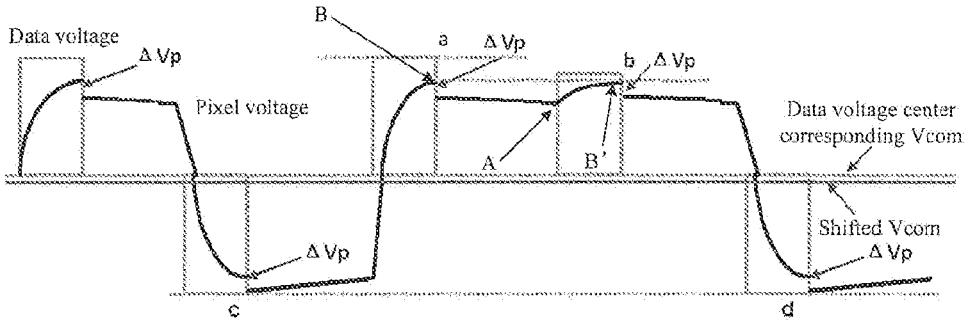
FIG. 5 is a schematic view showing the variations of the driving signal and the pixel voltage after executing the driving method according to an embodiment of the present invention.

As shown in FIG. 5 where a static image is taken as an example, the first three frames are within the signal non-conversion phase, i.e., they are driven by an existing mode, and the frames will enter the signal conversion phase from the fourth frame on.

As shown in FIG. 5, if an amplitude of the driving signal of the fourth frame is identical to an amplitude of the third frame, the fourth frame will continue to be positively charged from point A on. After the charging is completed, it will reach point B" (not shown), and its voltage is greater than the voltage at point B where the third frame is ended. At this time, the initial pixel voltage of the fourth frame will also be greater than that of the third frame, and flickering will occur.

If the method of the embodiment of the present invention is used, as shown in FIG. 5, the driving signal of the fourth frame has a polarity identical to the driving signal of the third frame, so the fourth frame continues to be positively charged from point A on. Because the amplitude of the driving signal decreases, after the charging is completed, it will only reach position B', and its voltage is substantially identical to the voltage at point B where the third frame is ended. At this time, the pixel voltages of the two frames will be substantially the same, thereby flickering will not occur.

In other words, at the first frame within the signal conversion phase, the polarity of the original driving signal is reversed and meanwhile the amplitude of the original driving signal is reduced, so that a difference between an absolute value (amplitude) of a first voltage of the pixel electrode driven by the target driving signal obtained after the reversion and an absolute value of a second voltage of the pixel driven by the original driving signal is less than a predetermined threshold.

Of course, ideally the absolute value of the first voltage is identical to that of the second voltage.

In an embodiment of the present invention, the reduced amplitude may be obtained in advance through experiments. For example, for each driving signal, at first a voltage A achievable for the pixel electrode is tested within the non-conversion phase, and the driving signal is modified according to a certain step so as to reduce the amplitude. The modified driving signal is reversed, and the reversed driving signal is used to drive the pixel electrode. A voltage B achievable for the pixel electrode is recorded, and the amount of change corresponding to the voltage B having an amplitude closest to that of the voltage A is found and recorded through experiments.

In actual use, at the first frame within the signal conversion phase, the original driving signal is reversed, then the target driving signal can be obtained by subtracting the amount of change corresponding to the original driving signal.

Of course, the above way is for illustrative purpose only, and the present invention is not limited to such a way to obtain the amount of change.

For a common liquid crystal television, embodiments of the present invention can be used to improve the line afterimages and reduce the flickering, especially for a relatively static image such as an icon of a TV station.

In an embodiment of the present invention, the entire display phase is divided into a plurality of signal conversion phases and a plurality of signal non-conversion phases, which are distributed sequentially at a regular interval.

In order to remove the line afterimages to the greatest extent, a difference between the durations of the signal conversion phase and the signal non-conversion phase is less than a predetermined threshold. Preferably, the two phases may have the same duration.

In a preferred embodiment, for different original signals, Step 403 may be implemented in different modes.

Mode 1

In this mode, Step 403 is executed by the timing controller and the data driving unit.

In this mode, the original input signal is a signal received by the timing controller, and Step 403 is executed by the timing controller and the data driving unit and comprises:

when the judgment result indicates that the current time is within the signal conversion phase, generating, by the timing controller, a first source signal based on the original input signal and outputting the first source signal, otherwise outputting a second source signal based on the original input signal; and processing, by the data driving unit, the first source signal and the second source signal from the timing controller according to a predetermined algorithm, and outputting the processed signal to the data line.

The first source signal is processed by the data driving unit according to the predetermined algorithm to obtain the original driving signal, and the second source signal is processed to obtain the target driving signal.

In this mode, the data driving unit is not changed, and the driving signal is changed by changing the timing controller TCON.

Generally, the data driving unit processes an output signal X from the timing controller in certain ways so as to obtain a driving signal Y. In other words, regardless of the structure of the data driving unit, there always exists a certain function relation between the driving signal Y and the output signal X from the timing controller in the case that the data driving unit is not changed. The change of the output signal from the timing controller will certainly lead to the change of the output signal Y from the data driving unit.

Presumed that $Y=f(X)$ and the timing controller in this mode outputs a signal $X1$ within the non-conversion phase, the data driving unit will output a driving signal $Y1=f(X1)$ according to the signal $X1$. The driving signal $Y1$ is just the original driving signal mentioned hereinbefore.

Within the signal conversion phase, the polarity of the original driving signal $Y1$ should be reversed, and meanwhile the amplitude of the first frame signal within the signal conversion phase should also be reduced, i.e., a target driving signal $Y2$ is known.

In the case that $Y2$ and the function relation between Y and X are known, $X2$ may be directly calculated according to $Y2$ by performing an inverse operation, i.e., $X2=g(Y2)$, wherein g is an inverse function of $f$.

From another perspective, $Y=f(X)$, so it is able to calculate the inverse function g of the function $f$, i.e., $X=g(Y)$. Then, $X1-X2=g(Y1)-g(Y2)$, i.e., $X2=X1-(g(Y1)-g(Y2))=g(Y1)-(g(Y1)-g(Y2))=g(Y2)$.

When mode 1 is used, it is able to generate the second source signal according to a difference between a grayscale corresponding to the target driving signal and a grayscale corresponding to the original driving signal and the first source signal, and then output the second source signal.

Mode 2

In mode 1, it is required to change the timing controller, while in this mode, the timing controller and the data driving unit are not changed, but the output signal from the data driving unit is changed.

In this mode, the original input signal is the original driving signal generated and output by the data driving unit. Step 403 comprises:

when the judgment result indicates that the current time is within the signal conversion phase, receiving the original driving signal from the data driving unit, processing the original driving signal to obtain the target driving signal, and outputting the target driving signal to the data line of the liquid crystal panel; and when the judgment result indicates that the current time is not within the signal conversion phase, receiving the original driving signal from the data driving unit, and directly outputting the original driving signal to the data line of the liquid crystal panel.

In this mode, the data driving unit and the timing controller operate in an original way to output the original driving signal. A unit is provided to intercept the original driving signal from the data driving unit, and a signal is directly superposed on the original driving signal within the signal conversion phase so as to obtain the target driving signal.

The method of the present invention may be applied to various electronic devices. Due to the special nature of a liquid crystal TV, a maximum effect will be obtained when the method of the present invention is applied to the liquid crystal TV.

Figure 6:
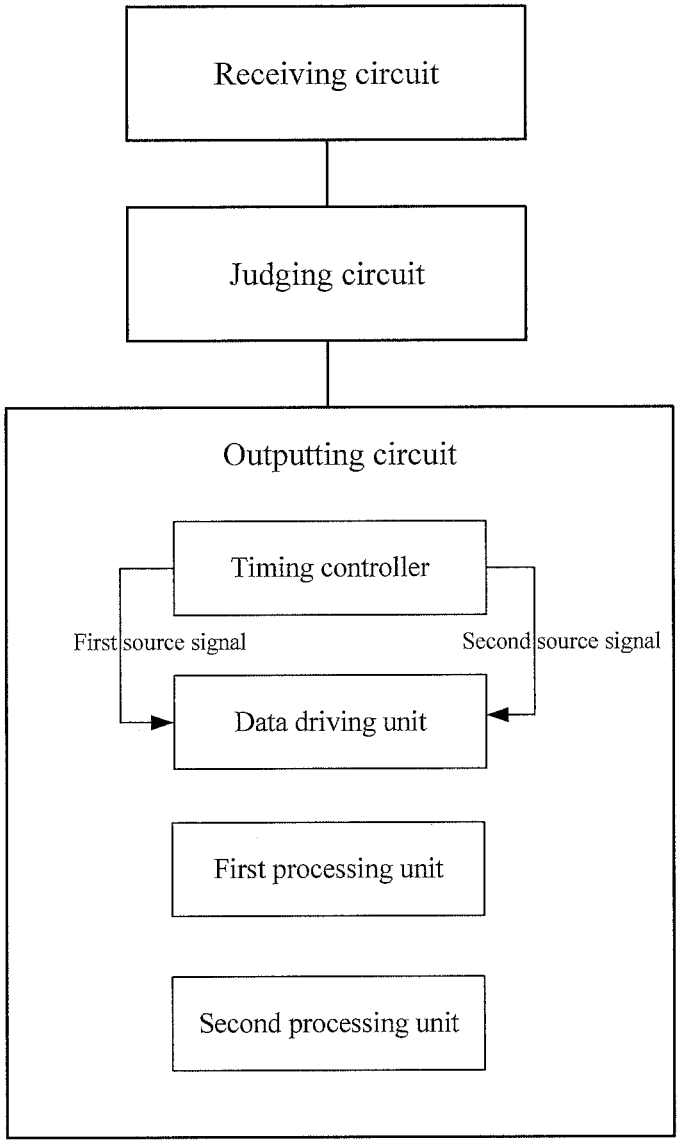
FIG. 6 is a schematic view showing the structure of a driving device for a liquid crystal panel according to an embodiment of the present invention.

The present invention further provides a driving device for a liquid crystal panel, used for an electronic device having the liquid crystal panel, which, as shown in FIG. 6, comprises:

a receiving module, configured to receive an original input signal;

a judging module, configured to judge whether or not a current time is within a signal conversion phase, to obtain a judgment result; and an outputting module, configured to, when the judgment result indicates that the current time is within the signal conversion phase, generate a target driving signal based on the original input signal, and output the target driving signal to a data line of the liquid crystal panel, otherwise, generate an original driving signal based on the original input signal and output the original driving signal to the data line.

The polarity of the target driving signal is opposite to that of the original driving signal. An amplitude of the target driving signal corresponding to a first frame within the signal conversion phase is less than an amplitude of the original driving signal.

The original input signal is a signal received by a timing controller, and the outputting module comprises:

a timing controller, configured to, when the judgment result indicates that the current time is within the signal conversion phase, generate a first source signal based on the original input signal and output the first source signal, otherwise output a second source signal based on the original input signal; and a data driving unit, configured to process the signal received by the timing controller according to a predetermined algorithm, and output the processed signal to the data line.

The first source signal is processed by the data driving unit according to the predetermined algorithm to obtain the original driving signal, and the second source signal is processed to obtain the target driving signal.

The timing controller is specifically configured to generate the second source signal based on a difference between a grayscale corresponding to the target driving signal and a grayscale corresponding to the original driving signal and the first source signal, and then output the second source signal.

The original input signal is the original driving signal generated and output by the data driving unit. The outputting module comprises:

a first processing unit, configured to, when the judgment result indicates that the current time is within the signal conversion phase, receive the original driving signal from the data driving unit, process the original driving signal to obtain the target driving signal, and output the target driving signal to the data line of the liquid crystal panel; and a second processing unit, configured to, when the judgment result indicates that the current time is not within the signal conversion phase, receive the original driving signal from the data driving unit, and directly output the original driving signal to the data line of the liquid crystal panel.

The electronic device may be a liquid crystal television.

The present invention further provides a display device comprising a liquid crystal panel and the above-mentioned driving device.

The above are merely the preferred embodiments of this utility model. It should be noted that, a person skilled in the art may make improvements and modifications without departing from the principle of the present invention, and these improvements and modifications shall also be considered as the scope of the present invention.

What is claimed is:

1. A driving method for a liquid crystal panel, used for an electronic device having the liquid crystal panel, comprising:

a reception step of receiving an original input signal;

a judgment step of judging whether or not a current time is within a signal conversion phase, to obtain a judgment result; and an output step of, when the judgment result indicates that the current time is within the signal conversion phase, generating a target driving signal based on the original input signal, and outputting the target driving signal to a data line of the liquid crystal panel so as to charge a pixel electrode, otherwise, generating an original driving signal based on the original input signal and outputting the original driving signal to the data line so as to charge the pixel electrode, wherein a polarity of the target driving signal is opposite to a polarity of the original driving signal, and an amplitude of the target driving signal corresponding to a first frame within the signal conversion phase is less than an amplitude of the original driving signal;

wherein the original input signal is the original driving signal generated and output by the data driving unit, and the output step comprises:

when the judgment result indicates that the current time is within the signal conversion phase, receiving the original driving signal from the data driving unit, processing the original driving signal to obtain the target driving signal, and outputting the target driving signal to the data line of the liquid crystal panel; and when the judgment result indicates that the current time is not within the signal conversion phase, receiving the original driving signal from the data driving unit, and directly outputting the original driving signal to the data line of the liquid crystal panel; wherein a difference between a first voltage of the pixel electrode driven by the target driving signal and a second voltage of the pixel electrode driven by the original driving signal is less than a predetermined threshold.

2. The driving method according to claim 1, wherein the original input signal is a signal received by a timing controller, the output step is executed by the timing controller and a data driving unit, and the output step comprises:

when the judgment result indicates that the current time is not within the signal conversion phase, generating, by the timing controller, a first source signal based on the original input signal and outputting the first source signal, otherwise generating and outputting a second source signal based on the original input signal; and processing, by the data driving unit, the first source signal and the second source signal from the timing controller according to a predetermined algorithm, and outputting processed signals to the data line, wherein the first source signal is processed by the data driving unit according to the predetermined algorithm to obtain the original driving signal, and the second source signal is processed to obtain the target driving signal.

3. The driving method according to claim 2, wherein in the output step, the second source signal is generated and output based on the first source signal and a difference between a grayscale corresponding to the target driving signal and a grayscale corresponding to the original driving signal.

4. The driving method according to claim 1, wherein the electronic device is a liquid crystal television.

5. A driving device for a liquid crystal panel, used for an electronic device having the liquid crystal panel, comprising:

a receiving circuit, configured to receive an original input signal;

a judging circuit, configured to judge whether or not a current time is within a signal conversion phase, to obtain a judgment result; and an outputting circuit, configured to, when the judgment result indicates that the current time is within the signal conversion phase, generate a target driving signal based on the original input signal, and output the target driving signal to a data line of the liquid crystal panel so as to charge a pixel electrode, otherwise, generate an original driving signal based on the original input signal and output the original driving signal to the data line so as to charge the pixel electrode, wherein a polarity of the target driving signal is opposite to a polarity of the original driving signal, and an amplitude of the target driving signal corresponding to a first frame within the signal conversion phase is less than an amplitude of the original driving signal;

wherein the original input signal is the original driving signal generated and output by the a data driving unit, and the outputting circuit comprises:

a first processing unit, configured to, when the judgment result indicates that the current time is within the signal conversion phase, receive the original driving signal from the data driving unit, process the original driving signal to obtain the target driving signal, and output the target driving signal to the data line of the liquid crystal panel; and a second processing unit, configured to, when the judgment result indicates that the current time is not within the signal conversion phase, receive the original driving signal from the data driving unit, and directly output the original driving signal to the data line of the liquid crystal panel;

wherein a difference between a first voltage of the pixel electrode driven by the target driving signal and a second voltage of the pixel electrode driven by the original driving signal is less than a predetermined threshold.

6. The driving device according to claim 5, wherein the original input signal is a signal received by a timing controller, and the outputting circuit comprises:

a timing controller, configured to, when the judgment result indicates that the current time is not within the signal conversion phase, generate a first source signal based on the original input signal and output the first source signal, otherwise generate and output a second source signal based on the original input signal; and a data driving unit, configured to process the first source signal and the second source signal from the timing controller according to a predetermined algorithm, and output processed signals to the data line, wherein the first source signal is processed by the data driving unit according to the predetermined algorithm to obtain the original driving signal, and the second source signal is processed to obtain the target driving signal.

7. The driving device according to claim 6, wherein the timing controller is specifically configured to generate the second source signal based on the first source signal and a difference between a grayscale corresponding to the target driving signal and a grayscale corresponding to the original driving signal, and output the second source signal.

8. The driving device according to claim 5, wherein the electronic device is a liquid crystal television.

9. A display device, comprising a liquid crystal panel, wherein the display device further comprises a driving device, the driving device comprising:

a receiving circuit, configured to receive an original input signal;

a judging circuit, configured to judge whether or not a current time is within a signal conversion phase, to obtain a judgment result; and an outputting circuit, configured to, when the judgment result indicates that the current time is within the signal conversion phase, generate a target driving signal based on the original input signal, and output the target driving signal to a data line of the liquid crystal panel so as to charge a pixel electrode, otherwise, generate an original driving signal based on the original input signal and output the original driving signal to the data line so as to charge the pixel electrode, wherein a polarity of the target driving signal is opposite to a polarity of the original driving signal, and an amplitude of the target driving signal corresponding to a first frame within the signal conversion phase is less than an amplitude of the original driving signal;

wherein the original input signal is the original driving signal generated and output by a data driving unit, and the outputting circuit comprises:

a first processing unit, configured to, when the judgment result indicates that the current time is within the signal conversion phase, receive the original driving signal from the data driving unit, process the original driving signal to obtain the target driving signal, and output the target driving signal to the data line of the liquid crystal panel; and a second processing unit, configured to, when the judgment result indicates that the current time is not within the signal conversion phase, receive the original driving signal from the data driving unit, and directly output the original driving signal to the data line of the liquid crystal panel;

wherein a difference between a first voltage of the pixel electrode driven by the target driving signal and a second voltage of the pixel electrode driven by the original driving signal is less than a predetermined threshold.

10. The display device according to claim 9, wherein the original input signal is a signal received by a timing controller, and the outputting circuit comprises:

a timing controller, configured to, when the judgment result indicates that the current time is not within the signal conversion phase, generate a first source signal based on the original input signal and output the first source signal, otherwise generate and output a second source signal based on the original input signal; and a data driving unit, configured to process the first source signal and the second source signal from the timing controller according to a predetermined algorithm, and output processed signals to the data line, wherein the first source signal is processed by the data driving unit according to the predetermined algorithm to obtain the original driving signal, and the second source signal is processed to obtain the target driving signal.

11. The display device according to claim 10, wherein the timing controller is specifically configured to generate the second source signal based on the first source signal and a difference between a grayscale corresponding to the target driving signal and a grayscale corresponding to the original driving signal, and output the second source signal.

* * * * *